United States Patent [19]

Copeland et al.

[11] Patent Number: 4,921,627

[45] Date of Patent: May 1, 1990

[54] DETERSIVE SYSTEM AND LOW FOAMING AQUEOUS SURFACTANT SOLUTIONS CONTAINING A MONO($C_{1-4}$ ALKYL)-DI($C_{6-20}$) ALKYLAMINE OXIDE COMPOUND

[75] Inventors: James L. Copeland, Burnsville; Daniel J. Donovan, St. Paul, both of Minn.

[73] Assignee: Ecolab Inc., St. Paul, Minn.

[21] Appl. No.: 250,975

[22] Filed: Sep. 23, 1988

Related U.S. Application Data

[63] Continuation of Ser. No. 931,398, Nov. 14, 1986, abandoned.

[51] Int. Cl.[5] ..... C11D 1/75; C11D 3/10

[52] U.S. Cl. ..... 252/99; 252/95; 252/102; 252/156; 252/528; 252/547; 252/DIG. 14

[58] Field of Search ..... 252/135, 528, 547, 540, 252/156, 174.21, 173, 95, 99, 102, DIG. 14; 564/297

[56] References Cited

U.S. PATENT DOCUMENTS

| | | | |
|---|---|---|---|
| 2,999,068 | 9/1961 | Pilcher et al. | 252/137 |
| 3,001,945 | 9/1961 | Drew et al. | 252/152 |
| 3,086,943 | 4/1963 | Lang | 252/152 |
| 3,270,060 | 8/1966 | Wakeman et al. | 260/583 |
| 3,441,612 | 4/1969 | Drew | 260/584 |
| 3,470,102 | 9/1969 | Heinz | 252/152 |
| 3,686,025 | 8/1972 | Morton | 117/140 R |
| 3,808,311 | 4/1974 | Olson et al. | 424/70 |
| 3,843,395 | 10/1974 | Morton | 117/109 |
| 3,898,187 | 8/1975 | Miller | 252/DIG. 14 |
| 3,943,234 | 3/1976 | Roggenkamp | 252/547 |
| 3,968,048 | 7/1976 | Bolan | 252/DIG. 10 |
| 3,983,079 | 9/1976 | Spadini et al. | 252/547 |
| 4,088,596 | 5/1978 | Arai et al. | 252/99 |
| 4,190,551 | 2/1980 | Murata et al. | 252/528 |
| 4,276,205 | 6/1981 | Ferry | 252/528 |
| 4,320,033 | 3/1982 | Yoshikawa | 252/547 |
| 4,337,165 | 6/1982 | Ando et al. | 252/105 |
| 4,421,740 | 12/1983 | Burton | 424/70 |
| 4,552,680 | 11/1985 | Hartman et al. | 252/547 |
| 4,606,850 | 8/1986 | Malik | 252/547 |
| 4,659,565 | 4/1987 | Smith et al. | 424/70 |
| 4,741,863 | 5/1988 | Yamamoto et al. | 252/547 |

FOREIGN PATENT DOCUMENTS

| | | |
|---|---|---|
| 936655 | 11/1973 | Canada . |
| 160762 | 11/1986 | European Pat. Off. . |
| 57-105495 | 6/1982 | Japan . |
| 58-46199 | 3/1983 | Japan . |
| 1294642 | 11/1972 | United Kingdom . |

OTHER PUBLICATIONS

Kirk-Othmer Encyclopedia of Chemical Technology, vol. 8, pp. 69-74.

Kirk-Othmer Encyclopedia of Chemical Technology, vol. 22, p. 332.

*Primary Examiner*—Prince E. Willis

*Attorney, Agent, or Firm*—Merchant, Gould, Smith, Edell, Welter & Schmidt

[57] ABSTRACT

A $C_{1-4}$ alkyl-di $C_{6-20}$ alkylamine oxide surfactant composition can be used in detersive systems. The amine oxide can be used in effective surfactant concentrations in aqueous alkaline solutions (pH about 7 or greater) producing an aqueous solution having halogen stability, reduced surface tension and low foaming properties. The surfactants have properties that are useful in detersive systems for hard surfaces, warewashing, laundry, clean-in-place, and other applications.

12 Claims, No Drawings

DETERSIVE SYSTEM AND LOW FOAMING AQUEOUS SURFACTANT SOLUTIONS CONTAINING A MONO($C_{1-4}$ ALKYL)-DI($C_{6-20}$) ALKYLAMINE OXIDE COMPOUND

This is a continuation of application Ser. No. 06/931,398, filed Nov. 14, 1986 now abandoned.

FIELD OF THE INVENTION

The invention relates to a novel class of surfactant compounds, to aqueous solutions containing an effective surface active amount of the novel surfactants and to detersive systems containing the surfactant as an active detergent ingredient. More particularly the invention relates to a class of low-foaming surfactants that, depending on pH can have both cationic and nonionic properties, can be stable in the presence of halogen bleaches, and can be used generally in detersive systems such as particulate, liquid and solid household and institutional warewashing detergents, laundry detergents, hard surface cleaners, clean-in-place agents, and others.

BACKGROUND OF THE INVENTION

Commonly a surfactant is an organic compound having at least one functional group that tends to be hydrophilic or water-seeking and at least one other functional group that tends to be hydrophobic or water hating. These functional groups can be assembled in surfactant molecules wherein the solubility, properties, location and relative sizes of the functional groups determines the surfactant properties of the compound.

The practical application of surfactants generally depends upon the properties of the surfactant in aqueous solution. Important properties of surfactants include the wetting power of aqueous solutions of surfactants, the ability of surfactants to dissolve normally water insoluble substances, the ability of surfactants to stabilize dispersed systems such as emulsions or suspensions, the ability of detersive systems (systems containing a detergent) to clean, the ability of surfactants to foam or resist foaming in aqueous solutions, the ability of surfactants to sanitize and others. Many types of surfactant molecules are known and are broadly classified as anionic, cationic, nonionic and amphoteric. Surfactant molecules can contain one or more of a variety of hydrophilic functional groups such as hydroxyl groups, ether linkages, groups derived from alkylene oxides such as ethylene oxide and propylene oxide; quaternary amines, ester linkages, amino groups, amido groups, carboxylic acid groups, sulfonic acid groups, and can contain one or more of hydrophilic groups such as alkyl groups, unsaturated alkenyl or alkynyl groups, aromatic groups, fatty acid residues, and many others. Such functional groups can easily be classified by the skilled artisan into groups that tend to be hydrophilic and groups that tend to be hydrophobic. However, the properties of the resulting surfactant molecules are not directly predictable since the contribution of each functional group is not fully quantifiable.

In general, high molecular weight tertiary amine oxide compounds have been recognized in the art. The prior art is primarily directed to two classes of surfactants which have been examined in great detail and have useful high-foaming surfactant properties. These compounds are typically the ($C_{8-18}$mono- alkyl)di(methyl) amine oxide compounds of the formula:

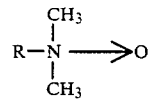

wherein R is a $C_{8-18}$ alkyl group and the mono-($C_{8-18}$ alkyl)di($C_{2-3}$ alkanol) amine oxide compounds of the formula:

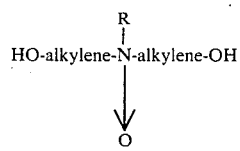

The commercial use of such amine oxide classes are discussed in *Kirk-Othmer Encyclopedia of Chemical Technology,* Vol. 1, pp. 32–47, *Kirk-Othmer Encyclopedia of Chemical Technology,* Vol. 19, pp. 556–559. See also Burton, U.S. Pat. No. 4,421,740, Ando et al, U.S. Pat. No. 4,337,165, Yoshikawa, U.S. Pat. No. 4,320,033, Russell, U.S. Pat. No. 3,843,395, Olson et al, U.S. Pat. No. 3,808,311, Morton, U.S. Pat. No. 3,686,025, Heinz, U.S. Pat. No. 3,470,102, Drew, U.S. Pat. No. 3,441,612, Wakeman et al, U.S. Pat. No. 3,270,060, Lang, U.S. Pat. No. 3,086,943, Drew et al, U.S. Pat. No. 3,001,945, Pilcher et al, U.S. Pat. No. 2,999,068, and British Pat. No. 1,294,642.

BRIEF DESCRIPTION OF THE INVENTION

We have found a novel surfactant class that comprises at least one compound or a mixture of compounds of the formula:

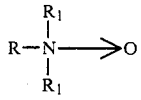

wherein R is a $C_{1-4}$ alkyl and each $R_1$ is independently a branched or unbranched aliphatic hydrocarbon group having more than 6 carbon atoms, and less than 20, preferably less than 14 carbon atoms.

The novel aqueous compositions of this invention comprise an effective amount, typically about 5 wt-% or less, of a mono-($C_{1-4}$ alkyl)di($C_{6-20}$ alkyl)-amine oxide compound sufficient to produce surfactant properties in an aqueous solution. We have found that such solutions have chlorine stability, substantially reduced surface tension, have low foaming properties, defoaming properties and antimicrobial sanitizing activity in specific pH ranges.

We have also found novel detersive systems that contain the novel surfactants of this invention in combination with other components. The unique properties of the surfactants of this invention provide warewashing detergents, hard surface cleaners and laundry detergents, clean-in-place compositions and other systems having novel and surprising properties.

DETAILED DESCRIPTION OF THE INVENTION

The mono-($C_{1-4}$ alkyl)-di- $C_{6-20}$ alkyl)amine oxide surfactant compounds of the invention comprise a compound according to the formula:

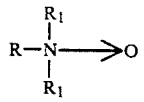

wherein R comprises an alkyl group of 1 to 4 carbon atoms and $R_1$ comprises a linear, branched or cyclic aliphatic group having 6 to 20, preferably 6 to 12 carbon atoms. Specific examples of $C_{6-20}$ linear or branched alkyl groups include hexyl, heptyl, 2-ethylhexyl, n-octyl, 2,2,4-trimethylpentyl, cyclohexyl, methylcyclohexyl, decyl, dodecyl, tetradecyl, hexadecyl, octadecyl, etc. The $C_{1-4}$ alkyl groups include methyl, ethyl, n-propyl, isopropyl, n-butyl, isobutyl, tertiary butyl. Specific examples of the preferred amine oxide surfactants for use in the novel aqueous solutions of the invention include dihexylmethylamine oxide, dioctylmethylamine oxide, didecylmethylamine oxide, octyldecylmethylamine oxide, decyldodecylmethylamine oxide, dodecyltetradecylmethylamine oxide, decyltetradecylmethylamine oxide, didodecylmethylamine oxide, dipentadecylmethylamine oxide, dihexadecylpropylamine oxide, dihexylisopropylamine oxide, dioctylethylamine oxide, didecylethylamine oxide, didodecylethylamine oxide, dipentadecylethylamine oxide, dihexadecylethylamine oxide, dioctylisopropylamine oxide, didecylisopropylamine oxide, didodecylisopropylamine oxide, dipentadecylisopropylamine oxide, dihexadecylisopropylamine oxide, and others.

The most preferred amine oxide surfactants are compounds of the formulae I wherein either (1) $R_1$ is octyl, decyl or mixtures thereof, (2) $R_1$ is octyl, (3) $R_1$ is decyl, or (4) $R_1$ is a mixture of decyl, dodecyl and tetradecyl. The mixtures of the surfactant compositions comprise a mixture of dioctyl methylamine oxide and didecyl amine oxide or a mixture of compounds wherein $R_1$ can be either octyl, decyl or a mixture of octyl and decyl.

We have found, surprisingly in comparison with dimethyl higher ($C_{18-24}$) alkylamine oxide that the aqueous solutions of the compounds of this invention exhibit excellent surfactant properties as shown in a substantial reduction in surface tension, surprising low foaming properties in view of the high foaming nature of the alkyl dimethylamine oxide surfactants, chlorine stability, excellent detersive properties and have a number of other properties not recognized in the prior art.

Amine oxides are typically formed from tertiary amines by an oxidative reaction creating the amine oxide functional group. Typically amine oxides are made by oxidizing a tertiary amine with hydrogen peroxide or other oxygen source. Such preparatory methods are discussed by Lake and Hoh in *J. Am. Oil Chemist Society.* 40, 628 (1963), The higher alkyl $C_{6-18}$ dimethylamine oxides were first developed as foam builders in liquid handwashing formulations. In addition to foam boosting, the higher alkyl dimethylamine oxides have been shown to be effective in high foaming shampoos and other end uses where foaming is important, We have found that the amine oxide compounds of this invention are preferably made by oxidizing the di-$C_{6-20}$ alkyl-$C_{1-4}$ alkylamine with hydrogen peroxide or other common oxidant (oxygen yielding substance) at elevated temperature. The tertiary amine compound is typically placed in a reaction flask and heated to an elevated temperature. Into the heated tertiary amine is slowly added an aqueous solution of oxidant (30 to 50 wt-%) over an extended period, At the end of the addition of the hydrogen peroxide, the reaction mixture is typically treated to dispel remaining hydrogen peroxide. The amine oxide compounds are formed at high yield with little residual amine.

Detersive Systems

The novel surfactant solutions of this invention can be used in the form of a detersive system. Detersive systems comprise a combination ingredients that when used primarily, but not always, in aqueous detergents can act to remove soil from a substrate. The detersive systems of this invention are typically liquids, gels, granular or particulate solids or cast solids. A detergent is a chemical compound that can weaken or break bonds between soil and a substrate. Detergents include surfactants, solvents, alkalis, and other compounds. A detersive system is typically used in a liquid cleaning bath which produces an enhanced cleaning effect that is caused primarily by the presence in the bath of a special solute (the detergent) that acts by altering the interfacial effects at the various phase boundaries (i.e. between soil, substrate and both) within the system. The action of the bath typically involves more than simply soil dissolution. The cleaning or washing process in a typical detersive system usually consists of the following sequence of operations. The soiled substrate is immersed or otherwise introduced into or contacted by a large excess of a bath containing a detergent solute. The soil and the underlying object or substrate typically becomes thoroughly wetted by the bath. The system is subjected to mechanical agitation by rubbing, shaking, spraying, mixing, or other action to provide a shearing action which aids in the separation of the soil from the substrate. The bath now containing the soil is typically removed from the object to be cleaned, the object is rinsed and often dried.

Most typically detersive systems are used in cleaning hard surfaces such as sinks, tiles, windows, and other glass, ceramic, plastic or other hard surface dishware and laundry or other textiles. Soils removed from substrates by the detersive systems are extremely variable in composition. They may be liquid, solid or a mixture thereof. The soils typically consist of mixtures of proteinaceous, carbohydrate, and fatty materials typically in combination with inorganic components and some water.

Detersive baths typically contain a detergent which is often an organic surfactant, an inorganic detersive component, or combinations of organic and inorganic components, and can typically be used in combination with other organic and inorganic components that provide additional properties or enhance the basic detersive property of the detersive component. The compositions dissolved or suspended in water to provide detersive systems are formulated to suit the requirements of the soiled substrate to be cleaned and the expected range of washing conditions. Few cleaning systems have a single component. Formulated detersive systems consisting of several components often out-perform single component systems. The materials which can be used independently in detersive systems are as follows:

(a) surfactants including various synthetic surfactants and natural soaps;

(b) inorganic builders, diluents, or fillers including salts, acids and bases;

(c) organic builder additives which enhance detergency, foaming power, emulsifying power, soil suspension;

(d) special purpose additives such as bleaching agents, brightening agents, enzymes, bactericides, anticorrosion agents, emollients, dyes, fragrances, etc.; and (e) hydrotrope solubilizers used to insure a compatible uniform mixture of components including alcoholic cosolvents, low molecular weight anionic surfactants, emulsifying agents, etc.

Surfactants

The detersive systems of this invention include the amine oxide surfactant composition disclosed herein. The properties of the amine oxide surfactant can be enhanced or augmented using a variety of other anionic, nonionic, cationic and amphoteric surfactants known in the art including soaps such as sodium or potassium salts of fatty acids, rosin acids, and tall oil; alkyl or alkyl benzene sulfonates; alkyl sulfates; long chain acid esters of polyethylene glycols; polyethylene glycol ethers of alkyl phenols; polyethylene glycol ethers of long chain alcohols and mercaptans; fatty acid diethanol amides; block copolymers of ethylene oxide and propylene oxide.

Preferred surfactants are the low foaming nonionic or anionic surfactant compositions. Cationic surfactants such as quaternary ammonium compounds are frequently used in detersive systems but are typically not cleansing ingredients and are used for purposes such as sanitizing or fabric softening.

Preferred surfactants for use with the amine oxide surfactants of this invention in the detersive systems comprise low foaming nonionic surfactants including block copolymers of ethylene oxide and propylene oxide, polyethylene glycol ethers of either alkyl phenols or long chain fatty alcohols. The ethylene oxide-propylene oxide block copolymers can contain from about 3 to about 50 moles of ethylene oxide in combination with about 3 to about 50 moles of propylene oxide. The alkoxylated alkyl phenols or the alkoxylated fatty alcohols can contain from about 3 to about 40 moles of the alkylene oxide, or mixtures thereof, in combination with 1 mole of the alkyl phenol or fatty alcohol.

Inorganic Compounds

Detersive systems can contain inorganic compounds which are typically grouped into the following six categories: alkalis, phosphates, silicates, neutral soluble salts, acids, and insoluble inorganic builders. The alkalis typically contains alkali metal hydroxides, alkali metal carbonates, alkali metal bicarbonates, alkali metal sesquicarbonate, and alkali metal borates. The carbonate and borate forms are typically used in place of alkali metal hydroxide when a higher pH is desired.

Inorganic phosphate compositions include monomeric phosphate compounds such as sodium orthophosphate and the higher condensed phosphates including tetraalkali metal pyrophosphates, sodium tripolyphosphate, glassy phosphates and others. Phosphates are typically used as sequestering, suspending and cleaning agents. Sodium tripolyphosphate is the most widely used builder in heavy detergents.

Silicates ($Na_2O:SiO_2$ compounds) which are typically a reaction product between sodium hydroxide and silica, have a variety of $Na_2O:SiO_2$ reaction ratios. Silicates are primarily used as alkalis as builders in both warewashing and laundry formulations.

Neutral soluble salts which are typically the reaction product of a strong acid and a strong base including sodium sulfate, sodium chloride, and others are typically used as builders or diluents in synthetic surfactant based detersive compositions.

Acids are often incorporated into hard surface detergents for the purpose of dissolving or loosening by chemical action soils which otherwise can be difficult to remove. Such soils include calcium and magnesium hardness components of service water and other mildly alkaline soil. Both organic and inorganic acids can be used. Inorganic acids include hydrochloric acid, sulfuric acid, phosphoric acids, and others. Organic acids that can be used include acetic acid, lactic acid, oxalic acid, citric acid, benzoic acid, and others. Insoluble organic builders are often used in both liquid, gel and solid detersive systems. The insoluble inorganics including clays, both natural and synthetic, montmorilonite clay, bentonite clay, can have a detersive effect in certain systems. Further, they can be used as suspending agents to maintain a liquid or gelled system.

Organic Builders and Additives

Further, the detersive systems can contain organic builders and other special purpose additives. This class of compounds are typically organic molecules having little detersive nature but containing many other desirable properties including antiredeposition additives, sequestrants, antifoaming or foaming additives, whiteners and brighteners, additives for maintaining the solubility of components, and additives for protecting both the substrate and the washing apparatus. The most common organic additives include organic sequestrants and organic antiredeposition agents. Organic sequestrants include compositions such as polyacrylic acid and methacrylic acid polymers, ethylene diamine tetraacetic acid, nitrilo triacetic acid, etc. and others. Antiredeposition agents include alkali metal carboxymethyl cellulose and others.

Common detersive systems in use today are laundry systems, industrial, institutional and household dishwashing or warewashing compositions, clean-in-place and hard surface cleaning compositions.

In aqueous dishwashing, detersive solutions are prepared from typically liquid, gelled, granular or cast solid detersive systems by the action of water within a warewashing machine. The surfactant of this invention can be used in detersive compositions prepared from solid cast, granular, particulate, powdered, gelled or liquid warewashing cleaners. The surfactant solutions must show effective soil removing properties, be resistant to any halogen source present in the cleaner, and should be low foaming or preferably defoaming.

Dishwashing detersive systems typically comprise a source of alkali in the form of an alkali metal hydroxide, alkali metal carbonate, or alkali metal silicate in combination with a hardness sequestering agent, optional surfactants, a source of halogen bleach, and other optional chemical substances. The amine oxide surfactant composition of this invention can be used in warewashing detersive systems since they are low-foaming, chlorine stable, and are useful at typical alkaline pH's found in dishwashing detersive systems to augment or enhance the soil removal properties of the alkali components.

The aqueous surfactant solutions of this invention are often used in a clean-in-place-cleaning environment in which the chemical properties of an aqueous solution pumped into a site requiring cleaning are relied on to the exclusion of mechanical soil removing processes in order to clean pipelines, process equipment, storage tanks, and other enclosed easily soiled locations. Such applications require significant detergency and stability to chemical soils. In most end uses, the novel surfactant compositions of the invention can be used in the form of an aqueous solution, prepared by diluting a concentrate, containing typically less than about 5,000 parts per million of the amine oxide surfactant, preferably for purposes of reducing cost of use, the surfactant compositions of this invention will contain less than 500 parts per million surfactant, and most preferably, as a result of the nature of surfactant compounds, optimum surfactant properties will be found in aqueous solutions containing the surfactants of this invention at a concentration of about 1 to 200 parts per million surfactant.

Laundry detersive systems typically in the form of liquid, gelled, granular, particulate or cast solid compositions can be used in both household and institutional laundry equipment to clean and destain typically soiled fabric articles. Cleaning of such articles is typically accomplished by removing soil that is physically associated with the fabric and by destaining or bleaching soils that cannot be removed by typical detersive systems. Laundry compositions typically comprise anionic or nonionic surfactants, water, softening or hardness sequestering agents, foam stabilizers, pH buffers, soil suspending agents, perfumes, brighteners, opacifiers, and colorants. If the laundry detersive system is in liquid form typically the components are dissolved or suspended in water, while if in a gelled form the water solution is typically combined with a gelling agent.

Further, the amine oxide surfactant compositions of this invention can be used in a variety of liquid detergent compositions that can be used in a variety of environments including hard surface cleaning, hand cleaning, general household cleaning, car washing, recreational equipment cleaning, etc. Such detersive systems are used in the form as shown below or in aqueous solution prepared from the compositions as shown below.

TABLE A

Warewashing Composition

| Component | Useful Wt % | Preferred Wt % | Most Preferred Wt % |
|---|---|---|---|
| Sequestrant | 1-80 | 20-60 | 25-50 |
| Source of alkalinity | 1-80 | 20-60 | 25-50 |
| Source of halogen bleach | 1-10 | 2-8 | 3-7 |
| Amine oxide | 0.01-10 | 0.1-8 | 0.5-7 |
| Water | 0-10 | 0-10 | .0-10 |

TABLE B

Preferred Warewashing Composition

| Component | Useful Wt % | Preferred Wt % | Most Preferred Wt % |
|---|---|---|---|
| Alkali metal tripolyphosphate | 20-80 | 30-70 | 25-50 |
| Alkali metal metasilicate | 20-80 | 30-70 | 25-50 |
| Alkali metal carbonate | 0-20 | 1-20 | 2-20 |
| Source of chlorine | 1-10 | 2-8 | 3-7 |

TABLE B-continued

Preferred Warewashing Composition

| Component | Useful Wt % | Preferred Wt % | Most Preferred Wt % |
|---|---|---|---|
| di $C_{6-20}$ alkyl methyl amine oxide | 0.01-10 | 0.1-8 | 0.5-7 |

TABLE C

Laundry Composition

| Component | Useful Wt % | Preferred Wt % | Most Preferred Wt % |
|---|---|---|---|
| Hardness sequestrant | 10-50 | 15-45 | 25-45 |
| Source of alkalinity | 0.5-30 | 1-25 | 5-20 |
| Cosurfactant (anionic) | 5-50 | 10-45 | 15-30 |
| Inorganic builder salt | 10-50 | 15-45 | 20-30 |
| Amine oxide surfactant | 0.1-20 | 1-15 | 1-10 |
| Water | 0-5 | 0-5 | 0-5 |

TABLE D

Preferred Laundry Composition

| Component | Useful Wt-% | Preferred Wt-% | Most Preferred Wt-% |
|---|---|---|---|
| Alkali metal tripolyphosphate | 5-50 | 10-45 | 15-40 |
| Alkali metal silicate | 0.5-25 | 1-20 | 5-15 |
| Sulfonate surfactant | 10-50 | 15-45 | 20-40 |
| Alkali metal sulfate builder salt | 5-50 | 10-45 | 15-40 |
| di $C_{6-20}$ alkyl methyl amine oxide | 0.1-20 | 0.5-15 | 1-10 |

TABLE E

Concentrated* Clean-in-Place Composition

| Component | Useful Wt-% | Preferred Wt-% | Most Preferred Wt-% |
|---|---|---|---|
| Strong base | 50-90 | 50-85 | 50-80 |
| Sequestrant | 10-50 | 15-45 | 20-40 |
| Amine oxide | 0.1-10 | 0.5-8 | 1-5 |
| Water | 0-5 | 0-5 | 0-5 |

*Use at about 0.5 to 5 wt-% active base.

TABLE F

Preferred Concentrated** Clean-in-Place Composition

| Component | Useful Wt-% | Preferred Wt-% | Most Preferred Wt-% |
|---|---|---|---|
| Alkali metal hydroxide | 50-90 | 50-85 | 50-80 |
| Alkali metal tripolyphosphate | 10-50 | 15-45 | 20-40 |
| di $C_{6-20}$ alkyl methyl amine oxide | 0.1-10 | 0.5-8 | 1-5 |
| Water | 0-5 | 0-5 | 0-5 |

**Use at about 0.5 to 5 Wt-% active alkali metal hydroxide.

TABLE G

Liquid Hard Surface Cleaner

| Component | Useful Wt-% | Preferred Wt-% | Most Preferred Wt-% |
|---|---|---|---|
| Nonionic surfactant | 0.1-25 | 0.5-20 | 1-15 |
| Hydrotrope | 0.1-25 | 0.5-20 | 1-15 |
| Amine oxide | 0.5-15 | 1-12 | 2-10 |

TABLE G-continued

| Liquid Hard Surface Cleaner | | | |
|---|---|---|---|
| Component | Useful Wt-% | Preferred Wt-% | Most Preferred Wt-% |
| Water | Balance | Balance | Balance |

TABLE H

| Preferred Liquid Hard Surface Cleaner | | | |
|---|---|---|---|
| Component | Useful Wt-% | Preferred Wt-% | Most Preferred Wt-% |
| $C_{1-12}$ alkyl phenol alkoxylate | 5–15 | 6–14 | 7–12 |
| $C_{1-12}$ alkyl benzene sulfonate hydrotrope | 5–20 | 7–15 | 8–12 |
| di $C_{6-20}$ alkyl methyl amine oxide | 1–10 | 2–9 | 3–8 |
| Water | Balance | Balance | Balance |

The foregoing provides a detailed discussion of the surfactant compositions of the invention, their manufacture and use. The following Examples further illustrate the invention and contain a best mode.

EXAMPLE I

Into a 1 liter resin flask equipped with a heater, mechanical stirrer, thermometer and addition funnel was placed 147.3 grams (0.74 mole) of dihexylmethylamine. The flask and its contents was heated and into the heated stirred tertiary amine was added 82.6 grams (0.845 mole) of 35 wt-% aqueous hydrogen peroxide in a drop-wise fashion from the addition funnel over a 1 hour and 15 minute period. At the beginning of the peroxide addition the temperature of the amine was 29.0° C. which slowly increased during addition to 70° C. At the end of 58 hours the mixture was cooled and transferred to a separatory funnel at 65° C. Into the funnel was added 280 grams of water and 13.1 grams of sodium sulfite. After dissolution of the sodium sulfite and shaking the solution, the contents of the flask formed two layers, the upper layer comprising an aqueous solution of the dihexyl methylamine oxide product, and the lower layer an aqueous salt. The bottom was removed and 131.3 grams of water were added to the amine oxide layer remaining in the separatory funnel. A moderate excess of sodium sulfite was treated with hydrogen peroxide. The product was analyzed and found to comprise 24.86% dihexylmethylamine oxide and 0.36% dihexylmethylamine.

EXAMPLE II

Into a 2 liter resin flask equipped with a heater, stirrer, and dropping addition funnel was placed 255 grams (1 mole) of dioctylmethylamine. The resin flask and its contents was heated to a temperature of 63° C. and into the heated stirred amine was added 120 grams (1.23 moles) of a 35 wt-% aqueous hydrogen peroxide solution over a period of 3 hours. An additional 30 grams (0.26 mole) of 35 wt-% aqueous peroxide was added 3 hours into the reaction. The reaction was continued for an additional 14 hours. At the end of that time the reaction mixture was treated with 0.13 grams of a 10% platinum on activated carbon catalyst to discharge excess hydrogen peroxide.

The amine oxide product was dissolved in an equal volume of $CH_2Cl_2$ and was filtered. The $CH_2Cl_2$ was stripped and the product was found to contain 87.2% dioctyl methylamine oxide and 1.2% free amine.

EXAMPLE III

Into a 2 liter resin reaction flask equipped with a heater, stirrer and dropping addition funnel was placed 283.1 grams of a tertiary amine comprising a mixture of 50% octyl decyl methylamine, 25% dioctyl methylamine, and 25% didecyl methylamine (1.0 moles, DAMA 810, Ethyl Corp.). The resin flask and its contents were heated to a temperature of about 70° C. and into the heated stirred tertiary amine was added 120 grams (1.23 moles) of a 35 wt-% aqueous hydrogen peroxide solution at an addition rate of 15 milliliters per each 10 minutes. Three hours into the reaction an additional 30 grams (0.26 moles) of hydrogen peroxide was added. At the end of a total reaction time of 21 hours, 0.10 grams of a 10% platinum on activated carbon catalyst was added to discharge excess hydrogen peroxide. The product was filtered, dissolved in an equal volume of $CH_2Cl_2$ and again filtered. The $CH_2Cl_2$ solvent was removed by stripping and the product was analyzed showing 87.6 wt-% amine oxide and 2.0 wt-% free amine.

EXAMPLE IV

Into a 2 liter resin reaction flask equipped with a heater, stirrer and dropping addition funnel was placed 311.0 grams of a didecyl methylamine (1.0 moles DAMA 10, Ethyl Corp.). The resin flask and its contents were heated to a temperature of 65° C. and into the heated amine was added 120 grams (1.23 moles) of a 35 wt-% aqueous hydrogen peroxide solution at a rate of 15 milliliters per each 10 minutes. 3 hours into the reaction time an additional 30 grams (0.26 moles) of a 35 wt-% aqueous hydrogen peroxide solution was added slowly to the reaction mixture. The reaction was continued for a total of 31 hours at 65° C. At the end of the reaction 0.10 grams of a 10% platinum on activated carbon catalyst was added to discharge excess hydrogen peroxide. The amine oxide product was dissolved in an equal volume of $CH_2Cl_2$ and filtered. The solvent was removed by stripping and the product contained 85.6 wt-% amine oxide and 2.05 wt-% free amine, indicating a 97.65% conversion.

EXAMPLE V

Following the procedure of Example IV except that a dicocomethylamine was substituted for the didecyl methylamine, a dicocomethylamine oxide product was formed having 83.3% dicocomethylamine oxide and 1.6 wt-% free amine in the product.

EXAMPLE VI

Into a 1 liter resin flask equipped with a heater, mechanical stirrer, thermometer and additional funnel was placed 226.6 grams of a distearyl methylamine (0.5 moles ADOGEN 349). The flask and its contents was heated to a temperature of about 70° C. and into the heated amine was added 60 grams of a 35 wt-% aqueous hydrogen peroxide solution drop-wise at a rate of 15 milliliters per each 10 minutes. The reaction was continued at 70° C. for 28 hours. At 5 hours, 13 hours, 21 hours, and 25 hours into the reaction an additional 15 grams (0.15 mole) of 35 wt-% hydrogen peroxide was added to the reaction mixture. The final product contained 45.7 wt-% amine oxide and 0.6 wt-% free amine.

The amine oxide surfactants of the invention were tested for dynamic foaming, surface tension and straight line gardner detergency. The following Tables summarize the data. The surface tension was measured in dynes per square centimeter on a Fisher Model 21 tensiometer with the indicated concentration of the amine oxide surfactant dissolved in deionized water measured at 70°-80° F.

TABLE 1

| | Dynamic Foaming Dialkyl Methylamine Temperature vs. Foam Height | | | | | | | |
|---|---|---|---|---|---|---|---|---|
| | Foam Height | | | | | $C_{14}$ Alkyl Dimethylamine Oxide | $C_{12}$ Alkyl Dimethylamine Oxide | |
| Temp. °C. | $diC_6$ | $diC_8$ | $diC_{10}$ | $diC_{12}$ | $diC_{14}$ | NINOX-M | NINOX-L | Pluronic L-62 |
| 78 | 3 | 2 | 1.5 | 1.75 | 1 | 9 | 9 | 2 |
| 88 | 2 | 1.75 | 1 | 1.25 | 0.25 | 9 | 9 | 1.8 |
| 92 | 1.5 | 1.5 | 0.8 | 1 | 0.25 | 9 | 9 | 1.7 |
| 100 | 1.25 | 1.5 | 0.75 | 0.75 | 0 | 9 | 9 | 1.25 |
| 108 | 1 | 1.25 | 0.5 | 0.6 | 0 | 9 | 9 | 0.50 |
| 124 | 1 | 0.8 | 0 | 0 | 0 | 9 | 9 | 0 |
| 136 | 1 | 0.33 | 0 | 0 | 0 | — | — | 0 |
| 150 | 1 | 0.25 | 0 | 0 | 0 | 9 | 9 | 0 |
| 156 | 1 | 0.25 | 0 | 0 | 0 | — | — | 0 |
| 160 | 1 | 0.25 | 0 | 0 | 0 | 9 | 9 | — |
| 176 | 1 | 0 | 0 | 0 | 0 | — | — | — |
| 180 | 1 | 0 | 0 | 0 | 0 | 9 | 9 | — |
| 184 | 1 | 0 | 0 | 0 | 0 | — | — | — |
| 190 | 1 | 0 | 0 | 0 | 0 | — | — | — |
| 194 | 1 | 0 | 0 | 0 | 0 | — | — | — |

TABLE 2

| | Surface Tension* Dynes/cm² | | |
|---|---|---|---|
| Concentration | $C_8$ Dialkyl | $C_{10}$ Dialkyl | $C_{12}$ Dialkyl |
| 5 | 55.1 | 39 | 33.1 |
| 10 | 53.5 | 34 | 28 |
| 20 | 49.9 | 29.5 | 24.9 |
| 50 | 41.25 | 24.7 | 24.7 |
| 100 | 36 | 23 | 24 |
| 150 | 34 | — | — |
| 200 | 32 | — | — |
| 1000 | 23 | — | — |

TABLE 3

| | Surface Tension Dynes/cm² | |
|---|---|---|
| Concentration | $C_{12}$ Alkyl | $C_{14}$ Alkyl |
| 5 | 57.1 | 57 |
| 10 | 53.3 | 46.9 |
| 20 | 43.2 | 40.1 |
| 50 | 38.2 | 36.9 |
| 100 | 35.3 | 37.3 |

*Measured by Fisher Model 21 Teniometer deionized water at 70-80° F.

The dynamic foaming data relating to the sufactant of the reaction were generated in a foam test device which is a cylindrical container 8 liters in volume, 15 centimeters in diameter, and 50 centimeters in height, equipped with an electric hot plate for temperature control, and a pump to recirculate the test solution at 6 p.s.i. via a means to direct a spray of the test solution onto the surface of the contents of the solution to generate foam. Three liters of test solution were prepared in soft water which contains 50 p.p.m. of the aqueous amine oxide surfactant. The tests were performed by recirculating the detergent solution through the spray means in the dynamic foam tester while the temperature was gradually increased 2°-3° F. per minute. At regular intervals the foam height above the water was observed.

The cleaning efficiencies of the surfactant compositions of this invention were measured using the gardner straight line detergency evaluation procedure in which a Gardner apparatus model WG6700 machine was used to clean standard soiled tiles with standard pressure and stroke of a sponge using use-dilution concentrations of surfactants on standard soiled tiles using an oily soil comprising 50% deodorized kerosene, 5% mineral oil, 5% #10 W motor oil, 2.5% of a dispersion of graphite in petroleum, and 37.5% black clay.

TABLE IV

| | Gardner Straight Line Detergency Evaluation |
|---|---|
| Surfactant | Soil Removal (%) |
| Nonylphenol ethoxylate (9.5 moles EO) | 37.7 |
| di $C_6$ alkyl methylamine oxide | 9.9 |
| di $C_8$ alkyl methylamine oxide | 36.0 |
| di $C_{10}$ alkyl methylamine oxide | 8.9 |
| di $C_{12}$ alkyl methylamine oxide | 7.4 |
| $C_8$ alkyl dimethylamine oxide | 8.9 |
| $C_{10}$ alkyl dimethylamine oxide | 19.6 |
| $C_{12}$ alkyl dimethylamine oxide | 22.5 |
| $C_{14}$ alkyl dimethylamine oxide | 24.3 |

The above tables of data indicate that the dialkyl methylamine oxide surfactants of the invention have significant surface tension, low foaming properties and detergency.

The following exemplary detersive compositions are made using the amine oxide surfactant similar to those prepared in the above Examples.

EXAMPLE A

A granular laundry system was prepared comprising 40.0% sodium tripolyphosphate, 20.0% didodecylmethylamine oxide (75% active in water), 10% sodium metasilicate, and 30% sodium carbonate by adding the sodium tripolyphosphate to a 1.5 liter ribbon blender. The amine oxide was absorbed on the tripolyphosphate and the balance of the particulates were added until blended.

EXAMPLE B

A granular laundry system was prepared according to Example A except that nonylphenol 9.5 mole ethoxylate was used to entirely replace the amine oxide.

A tergotometer device was used to evaluate the two compositions. The following conditions were used:

| | |
|---|---|
| RPM rate | 150 |

-continued

| | |
|---|---|
| Wash time | 5 minutes |
| Wash volume | 800 mls. |
| Detergent concentration | 2 grams (0.25 wt/wt) |
| Temperature | 50° C. |
| Water type | Distilled |
| Soil fabric type | Dacron 54 W/cotton polyester 65/35 Shirting material with durable press Finish soiled with clay, lamp black, iron oxide and lanolin soil supplied by Test Fabrics, Inc., Middlesex, N.J., U.S.A. |

Under the above test conditions Example B gave a soil removal of 42.3%, whereas Example A gave a soil removal of 46.0%. Each value is the average of three separate experiments. Soil removal was measured using a Hunter Lab D2504 color difference meter.

EXAMPLE C

A granular warewashing system was prepared comprising 35 wt-% sodium tripolyphosphate, 3.0% didodecylmethylamine oxide, 40% sodium metasilicate, 20% sodium carbonate, and 2% sodium dichlorodiisocyanurate dihydrate by adding the sodium tripolyphosphate to a 1.5 liter ribbon blender. The didodecylmethylamine oxide surfactant was added to and absorbed onto the sodium tripolyphosphate and the balance of the particulate ingredients were added and blended until uniform.

EXAMPLE D

Hard Surface Cleaner

A liquid, aqueous hard surface cleaner was prepared comprising 6% didodecylmethylamine oxide, 10% nonyl phenol 9.5 ethoxylate, 10% sodium xylene sulfonate hydrotrope, and 74% water by adding to water contained in a glass beaker the recited ingredients.

EXAMPLE E

Clean-in-Place Composition Concentrate

A granular, clean-in-place concentrate composition was prepared comprising 3 wt-% dioctylmethylamine oxide, 2% water, 25% sodium tripolyphosphate, and 70% solid pellet sodium hydroxide. The composition was prepared by adding the dioctylmethylamine oxide in the water to the sodium tripolyphosphate in a 1.5 liter ribbon blender. After the amine oxide was absorbed on the tripolyphosphate, the sodium hydroxide was slowly added and blended until uniform.

The above specification, Examples and data provide a detailed discussion of the surfactants, detersive systems, and methods of the invention. However, since the invention can be present in a variety of embodiments that contain the spirit and scope of the invention, the invention is found within the claims hereinafter appended.

We claim:

1. A warewashing detersive system comprising:

(a) about 1 to 80 wt-% of a source of alkalinity;
(b) 1 to 80 wt-% of a hardness sequestering agent;
(c) 1 to 10 wt-% of a source of active halogen; and
(d) 0.01 to 10 wt-% of a surfactant of the formula:

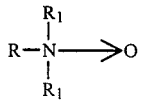

wherein R is $C_{1-4}$ aliphatic group and each $R_1$ is independently a linear or branched aliphatic hydrocarbon group having an average of about 6 to 20 carbon atoms.

2. The system of claim 1 wherein the source of alkalinity comprise an alkali metal silicate, an alkali metal carbonate, an alkali metal bicarbonate, an alkali metal hydroxide, or mixtures thereof.

3. The system of claim 1 wherein the hardness sequestering agent comprises a polyacrylic acid polymer, an alkali metal tripolyphosphate, an alkali metal nitrilo triacetic acid, an alkali metal salt of ethylene diamine tetraacetic acid, or mixtures thereof.

4. The system of claim 1 wherein the source of active halogen comprises an alkali metal hypochlorite, an alkali metal dichloroisocyanurate, or mixtures thereof.

5. The system of claim 1 wherein in the surfactant, each $R_1$ is independently a $C_{6-18}$ group and the average number of carbon atoms in the $R_1$ groups is less than 14.

6. The system of claim 1 wherein R is methyl and each $R_1$ is independently selected from a $C_{8-12}$ alkyl group.

7. The system of claim 1 which comprises a liquid warewashing system additionally comprising 0 to 10 wt-% of water.

8. The detersive system of claim 1 wherein the detersive system is in the form of a granular solid.

9. A clean-in-place concentrate composition comprising:

(a) a major proportion of an alkali metal hydroxide;
(b) about 5 to 50 wt-% of alkali metal tripolyphosphate;
(c) about 0.1 to 10 wt-% of a surfactant of the formula

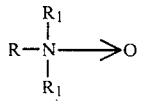

wherein R is $C_{1-4}$ aliphatic group and each $R_1$ is independently a linear or branched aliphatic $C_{6-20}$ hydrocarbon group.

10. The concentrate composition of claim 9 wherein the alkali metal hydroxide comprises sodium hydroxide.

11. The concentrate composition of claim 9 wherein the alkali metal tripolyphosphate comprises sodium tripolyphosphate.

12. The concentrate composition of claim 9 wherein the surfactant comprises didecylmethylamine oxide.

* * * * *